US006237884B1

(12) United States Patent
Howe

(10) Patent No.: US 6,237,884 B1
(45) Date of Patent: May 29, 2001

(54) CEILING FAN MOUNTING ASSEMBLY

(76) Inventor: Stephen E. Howe, 748 Dallas Dr., Saint Louis, MO (US) 63125

( * ) Notice: Subject to any disclaimer, the term of this patent is extended or adjusted under 35 U.S.C. 154(b) by 0 days.

(21) Appl. No.: 09/324,638

(22) Filed: Jun. 3, 1999

(51) Int. Cl.[7] ..... E04G 25/00
(52) U.S. Cl. ..... 248/200.1; 248/343
(58) Field of Search ..... 248/200.1, 544, 248/546, 547, 343, 216.4, 217.3; 220/3.5, 3.9; 416/244 R; 52/39; 174/50, 58, 63

(56) References Cited

U.S. PATENT DOCUMENTS 2,018,487 * 10/1935 Cornish ..... 174/63
3,518,421 * 6/1970 Cogdill ..... 248/57
4,909,405 * 3/1990 Kerr, Jr. ..... 220/3.9
5,024,412 * 6/1991 Hung et al. ..... 248/343
5,522,577 * 6/1996 Roesch ..... 248/343
5,672,002 * 9/1997 Todd, Jr. ..... 362/294
5,800,049 * 9/1998 Todd, Jr. ..... 362/294
5,845,886 * 12/1998 McCormick ..... 248/200.1
5,938,157 * 8/1999 Reiker ..... 248/200.1
5,939,671 * 8/1999 Gretz ..... 174/50

* cited by examiner

*Primary Examiner*—Anita M. King
*Assistant Examiner*—Gwendolyn Baxter

(57) ABSTRACT

A ceiling fan mounting assembly for suspending a ceiling fan directly below a skylight. The ceiling fan mounting assembly includes a mounting bracket with a plurality of elongate mounting arms outwardly radiating from a center region of the mounting bracket. A mounting box is downwardly depended from the center region of the mounting bracket. Each of the mounting arms has an outer end opposite the center region of the mounting bracket with a mounting plate coupled thereto. Each of the mounting plates has a mounting barb outwardly extending therefrom.

10 Claims, 2 Drawing Sheets

CEILING FAN MOUNTING ASSEMBLY

BACKGROUND OF THE INVENTION

1. Field of the Invention

The present invention relates to ceiling fan mounting assemblies and more particularly pertains to a new ceiling fan mounting assembly for suspending a ceiling fan directly below a skylight.

2. Description of the Prior Art

The use of ceiling fan mounting assemblies is known in the prior art. More specifically, ceiling fan mounting assemblies heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,717,099; U.S. Pat. No. 4,909,405; U.S. Pat. No. 2,809,002; U.S. Pat. No. 2,945,661; U.S. Pat. No. 2,713,983; and U.S. Pat. No. Des. 288,289.

While these devices fulfill their respective, particular objectives and requirements, the aforementioned patents do not disclose a new ceiling fan mounting assembly. The inventive device includes a mounting bracket with a plurality of elongate mounting arms outwardly radiating from a center region of the mounting bracket. A mounting box is downwardly depended from the center region of the mounting bracket. Each of the mounting arms has an outer end opposite the center region of the mounting bracket with a mounting plate coupled thereto. Each of the mounting plates has a mounting barb outwardly extending therefrom.

In these respects, the ceiling fan mounting assembly according to the present invention substantially departs from the conventional concepts and designs of the prior art, and in so doing provides an apparatus primarily developed for the purpose of suspending a ceiling fan directly below a skylight.

SUMMARY OF THE INVENTION

In view of the foregoing disadvantages inherent in the known types of ceiling fan mounting assemblies now present in the prior art, the present invention provides a new ceiling fan mounting assembly construction wherein the same can be utilized for suspending a ceiling fan directly below a skylight.

The general purpose of the present invention, which will be described subsequently in greater detail, is to provide a new ceiling fan mounting assembly apparatus and method which has many of the advantages of the ceiling fan mounting assemblies mentioned heretofore and many novel features that result in a new ceiling fan mounting assembly which is not anticipated, rendered obvious, suggested, or even implied by any of the prior art ceiling fan mounting assemblies, either alone or in any combination thereof.

To attain this, the present invention generally comprises a mounting bracket with a plurality of elongate mounting arms outwardly radiating from a center region of the mounting bracket. A mounting box is downwardly depended from the center region of the mounting bracket. Each of the mounting arms has an outer end opposite the center region of the mounting bracket with a mounting plate coupled thereto. Each of the mounting plates has a mounting barb outwardly extending therefrom.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new ceiling fan mounting assembly apparatus and method which has many of the advantages of the ceiling fan mounting assemblies mentioned heretofore and many novel features that result in a new ceiling fan mounting assembly which is not anticipated, rendered obvious, suggested, or even implied by any of the prior art ceiling fan mounting assemblies, either alone or in any combination thereof.

It is another object of the present invention to provide a new ceiling fan mounting assembly which may be easily and efficiently manufactured and marketed.

It is a further object of the present invention to provide a new ceiling fan mounting assembly which is of a durable and reliable construction.

An even further object of the present invention is to provide a new ceiling fan mounting assembly which is susceptible of a low cost of manufacture with regard to both materials and labor, and which accordingly is then susceptible of low prices of sale to the consuming public, thereby making such ceiling fan mounting assembly economically available to the buying public.

Still yet another object of the present invention is to provide a new ceiling fan mounting assembly which provides in the apparatuses and methods of the prior art some of the advantages thereof, while simultaneously overcoming some of the disadvantages normally associated therewith.

Still another object of the present invention is to provide a new ceiling fan mounting assembly for suspending a ceiling fan directly below a skylight.

Yet another object of the present invention is to provide a new ceiling fan mounting assembly which includes a mounting bracket with a plurality of elongate mounting arms outwardly radiating from a center region of the mounting bracket. A mounting box is downwardly depended from the center region of the mounting bracket. Each of the mounting arms has an outer end opposite the center region of the mounting bracket with a mounting plate coupled thereto. Each of the mounting plates has a mounting barb outwardly extending therefrom.

Still yet another object of the present invention is to provide a new ceiling fan mounting assembly that is adjustable to fit variously sized skylight openings.

Even still another object of the present invention is to provide a new ceiling fan mounting assembly that has mounting barbs to help hold the assembly in place when mounting it to a skylight opening and also providing guide holes to remount the assembly after it has been removed for servicing and maintenance.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
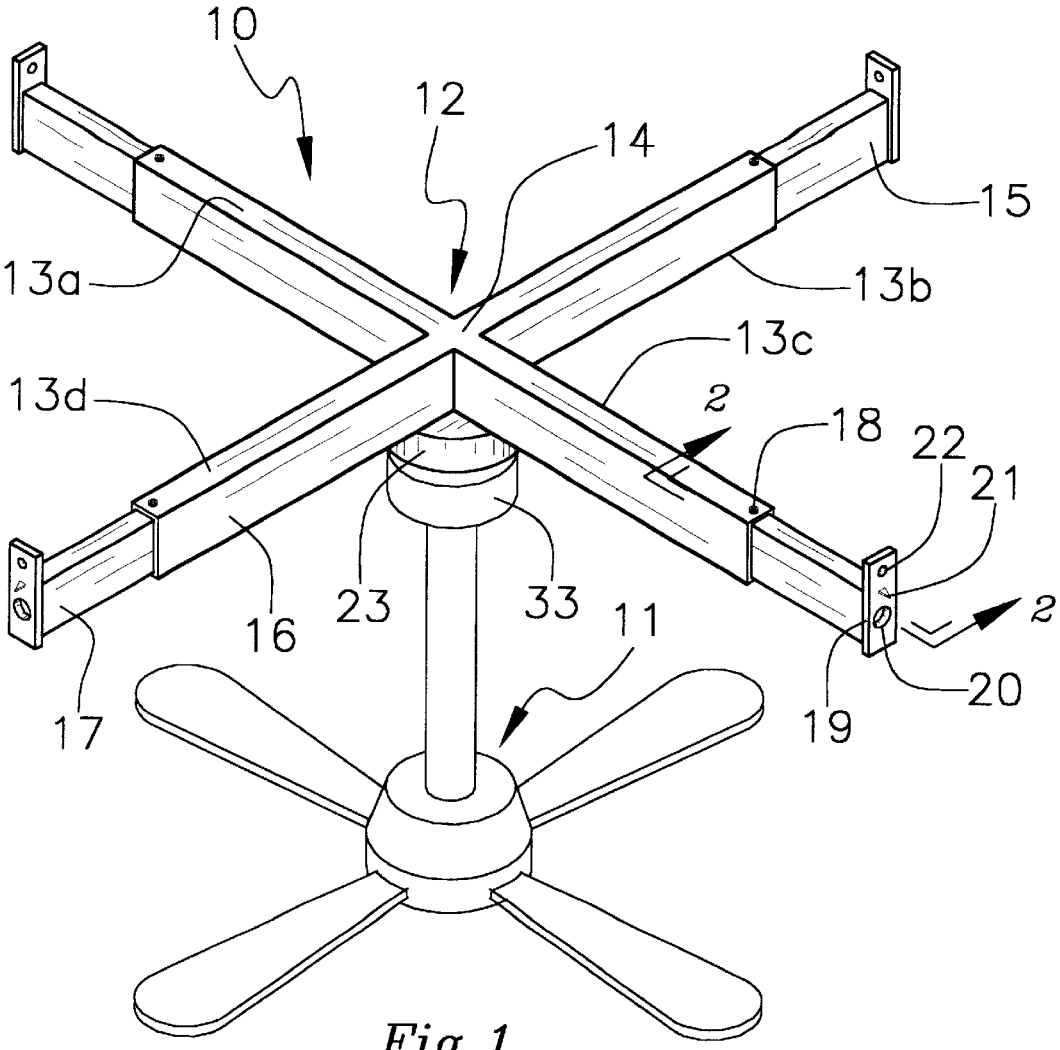
FIG. 1 is a schematic perspective view of a new ceiling fan mounting assembly according to the present invention.
Figure 2:
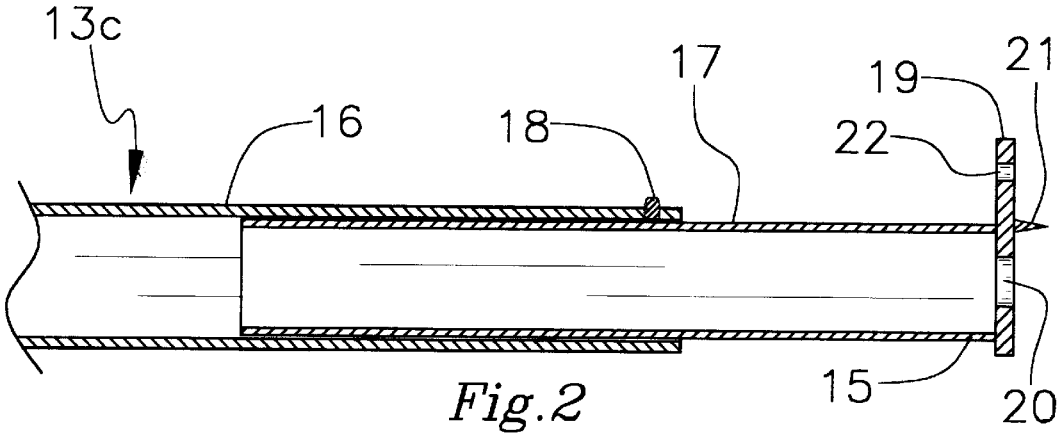
FIG. 2 is a schematic cross sectional view taken from line 2—2 of FIG. 1.
Figure 3:
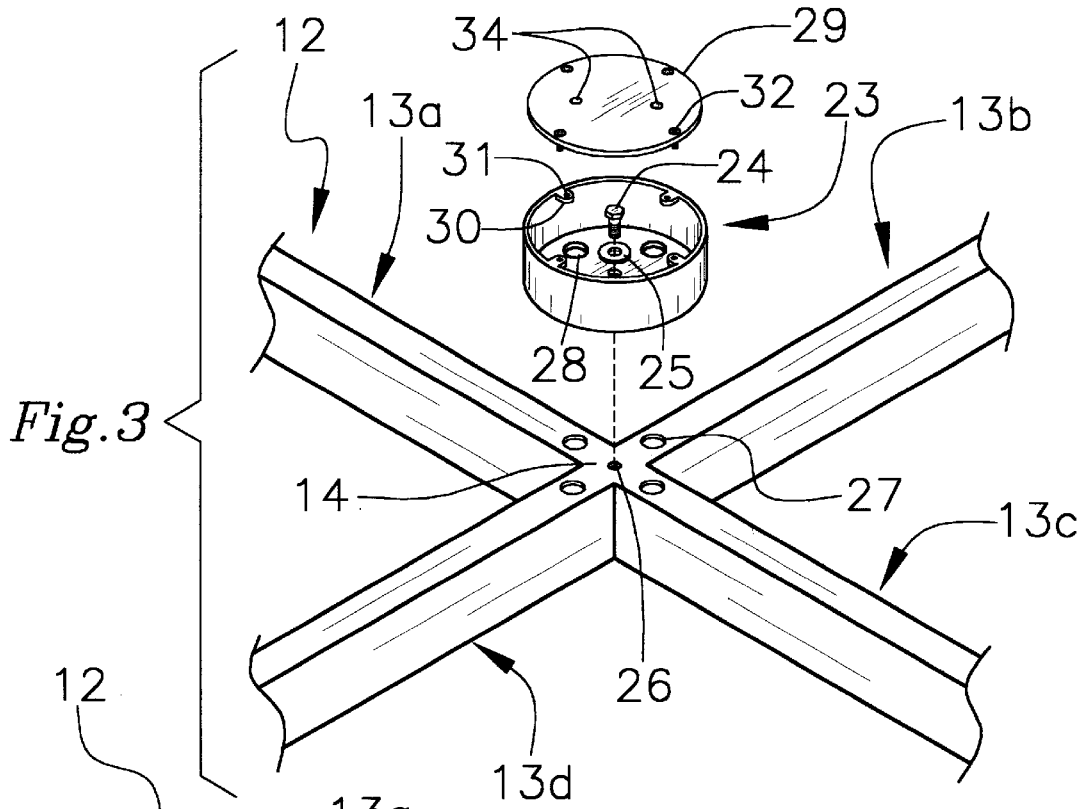
FIG. 3 is a schematic exploded perspective view of a central area of the present invention.
Figure 4:
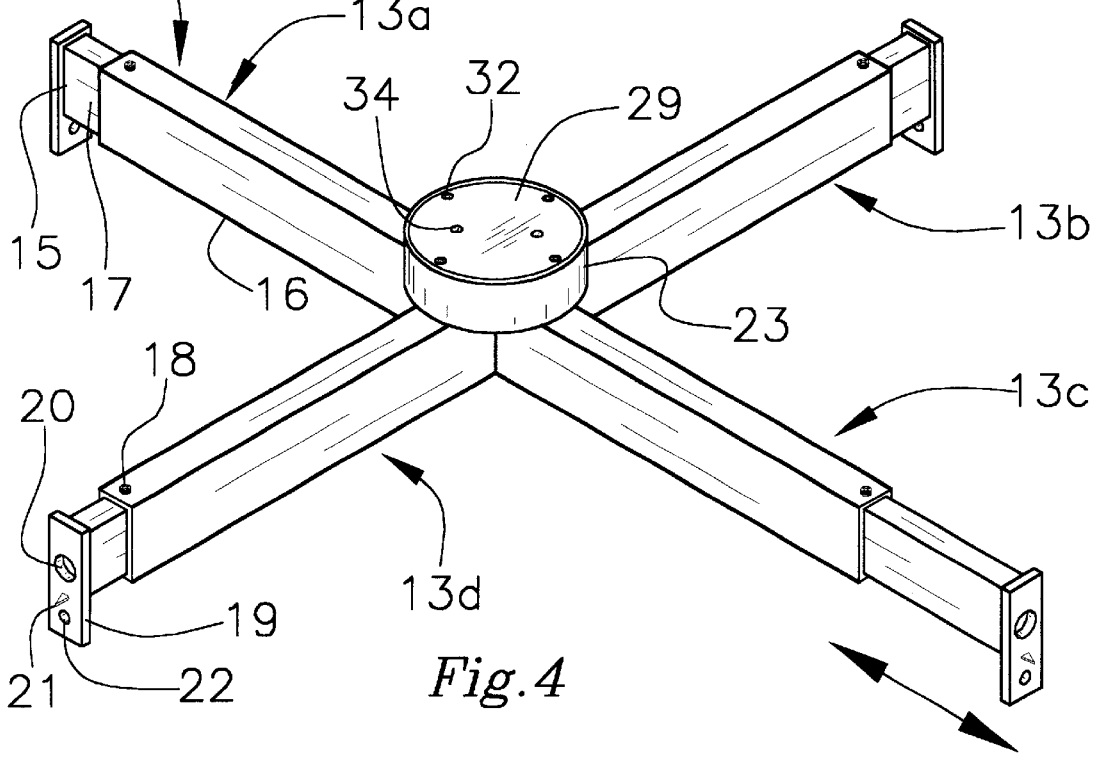
FIG. 4 is a schematic perspective view of the bottom of the present invention.

With reference now to the drawings, and in particular to FIGS. 1 through 4 thereof, a new ceiling fan mounting assembly embodying the principles and concepts of the present invention and generally designated by the reference numeral 10 will be described.

As best illustrated in FIGS. 1 through 4, the ceiling fan mounting assembly 10 generally comprises a mounting bracket with a plurality of elongate mounting arms outwardly radiating from a center region of the mounting bracket. A mounting box is downwardly depended from the center region of the mounting bracket. Each of the mounting arms has an outer end opposite the center region of the mounting bracket with a mounting plate coupled thereto. Each of the mounting plates has a mounting barb outwardly extending therefrom.

In closer detail, the ceiling fan mounting assembly 10 is designed for mounting a ceiling fan 11 to a plurality of side surfaces defining a skylight opening in a ceiling structure. Specifically, the ceiling fan mounting assembly includes a mounting bracket 12 comprising a plurality of elongate mounting arms 13*a*,13*b*,13*c*,13*d* outwardly radiating from a center region 14 of the mounting bracket. Preferably, each of the mounting arms is tubular and has a generally rectangular transverse cross section. The mounting arms also preferably lying in a common plane with one another. The mounting bracket preferably has a generally cross-shaped configuration so that the mounting arms each are extended substantially perpendicular to the adjacent mounting arms.

Each of the mounting arms is telescopically extendable and has an outer end 15 opposite the center region of the mounting bracket, and elongate inner and outer portions 16,17. Preferably, the inner portion of each mounting arm telescopically receives therein the outer portion of the respective mounting arm such that the outer portion is telescopically extendable from the associated inner portion. Even more preferably, each of the mounting arms has a set screw 18 extending therein for releasably holding the inner and outer portions of the respective mounting arm in a fixed position with respect to one another.

The outer ends of the mounting arms each have a generally rectangular mounting plate 19 coupled thereto. The mounting plates preferably lie in planes extending substantially perpendicular to the common plane of the mounting arms. The mounting plates each are designed for abutting against a corresponding adjacent surface of a skylight opening in a ceiling structure so that the mounting bracket is positioned in the skylight opening preferably with the center region of the mounting centered in the skylight opening.

Each of the mounting plates preferably has a generally circular knock out hole 20 therethrough providing an opening into the outer end of the associated mounting arm to permit extension of electrical conduits therethrough from the ceiling structure into the mounting arm. Ideally, each knockout hole has an outer diameter of about 1 inch to provide sufficient clearance to run electrical wiring sufficient for supplying power to a ceiling fan.

Each of the mounting plates has a generally triangular-shaped mounting barb 21 outwardly extending therefrom. The mounting barbs each are designed for insertion into the respective corresponding surface of the skylight opening to temporarily secure the mounting plates to the surface of the skylight opening.

Each of the mounting plates has an upper region upwardly extending from the associated mounting arm. In the upper region of each mounting plate is a generally circular mounting hole 22 therethrough. The mounting holes of the mounting plates each are designed for extending a fastener such as a lag bolt therethrough and into the respective corresponding surface of the skylight opening to secure the mounting plates to the surfaces of the skylight opening. The mounting hole each preferably has an outer diameter less than the outer diameter of the knockout hole. Ideally, the outer diameter of each mounting hole is about 3/16 inch to permit extension of a 3/16 lag bolt therethrough to help ensure that the mounting bracket is strongly secured to the surfaces of the skylight opening.

A preferably generally cylindrical mounting box 23 is downwardly depended from the center region of the mounting bracket. The mounting box is coupled to the center region of the mounting bracket by a threaded fastener 24 and washer 25 combination extended through the mounting box and into a threaded hole 26 in a lower face of the center region of the mounting bracket.

Each of the mounting arms preferably has a downwardly facing generally circular wiring hole 27 adjacent the center region of the mounting bracket. Similarly, the mounting box has a plurality of upwardly facing generally circular extension holes 28. Each of the extension holes is coaxially aligned with a corresponding adjacent wiring hole to permit extension of electrical conduit running through the mounting arms into the mounting box via the wiring and extension holes.

The mounting box preferably has a generally circular removable bottom plate 29 coupled thereto and covering a bottom opening of the mounting box. Ideally, the mounting box has a plurality of inwardly extending mounting tabs 30 each with a hole therein. The bottom plate has a plurality of holes 32 therethrough with each of the holes of the mounting box being coaxially aligned with a corresponding adjacent mounting tab hole so that a fastener may be extended through each associated pair of holes to couple the bottom plate to the mounting box.

In use, the bottom plate of the mounting box is designed for coupling a base 33 of a ceiling fan thereto such that the ceiling fan downwardly depends from the mounting box. The bottom plate of the mounting box preferably has a spaced apart of generally circular fan mounting holes 34 designed for extending fasteners therethrough to secure the base of the ceiling fan to the bottom plate of the mounting box. Access holes may also be drilled into the bottom plate of the mounting box to permit extension of electrical conduit therethrough to electrically connect the ceiling fan to an electrical power supply via electrical conduit extended through the mounting bracket.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A ceiling fan mounting assembly, comprising:

a mounting bracket comprising a plurality of elongate mounting arms outwardly radiating from a center region of said mounting bracket;

a mounting box being downwardly depended from said center region of said mounting bracket;

each of said mounting arms having an outer end opposite said center region of said mounting bracket;

said outer ends of said mounting arms each having a mounting plate coupled thereto;

each of said mounting plates having a mounting barb outwardly extending therefrom;

wherein said each of said mounting arms is telescopically extendable; wherein said each of said mounting arms has elongate inner and outer portions, said inner portion of each mounting arm telescopically receiving therein said outer portion of a respective mounting arm such that said outer portion is telescopically extendable from an associated inner portion; and wherein said each of said mounting arms has a set screw extending therein for releasably holding said inner and outer portions of said respective mounting arm in a fixed position with respect to one another.

2. The ceiling fan mounting assembly of claim 1, wherein said each of said mounting plates has a knock out hole therethrough providing an opening into said outer end of an associated mounting arm.

3. The ceiling fan mounting assembly of claim 1, wherein said each of said mounting plates has an upper region upwardly extending from an associated mounting arm, and wherein said upper region of each mounting plate has mounting hole therethrough adapted for extending a fastener therethrough.

4. The ceiling fan mounting assembly of claim 1, wherein said each of said mounting arms has a downwardly facing wiring hole adjacent said center region of said mounting bracket, wherein said mounting box has a plurality of upwardly facing extension holes, each of said extension holes being coaxially aligned with a corresponding adjacent wiring hole.

5. The ceiling fan mounting assembly of claim 1, wherein said mounting box having a removable bottom plate coupled thereto and covering a bottom opening of said mounting box.

6. A ceiling fan mounting assembly for mounting a ceiling fan to side surfaces defining a skylight opening in a ceiling structure, said ceiling fan mounting assembly comprising:

a mounting bracket having a generally cross-shaped configuration and comprising a plurality of elongate mounting arms outwardly radiating from a center region of said mounting bracket;

said each of said mounting arms being tubular and having a generally rectangular transverse cross section, said mounting arms lying in a common plane with one another, said mounting arms each being extended substantially perpendicular to an adjacent mounting arms;

said each of said mounting arms being telescopically extendable and having an outer end opposite said center region of said mounting bracket, and elongate inner and outer portions, said inner portion of each mounting arm telescopically receiving therein said outer portion of a respective mounting arm such that said outer portion is telescopically extendable from a associated inner portion;

said each of said mounting arms having a set screw extending therein for releasably holding said inner and outer portions of the respective mounting arm in a fixed position with respect to one another;

said outer ends of said mounting arms each having a generally rectangular mounting plate coupled thereto, said mounting plates lying in planes extending substantially perpendicular to said common plane of said mounting arms;

said mounting plates each being adapted for abutting against a corresponding adjacent surface of the skylight opening;

said each of said mounting plates having a generally circular knock out hole therethrough providing an opening into said outer end of the associated mounting arm;

said each of said mounting plates having a generally triangular-shaped mounting barb outwardly extending therefrom, said mounting barbs each being adapted for insertion into a respective corresponding surface of the skylight opening;

said each of said mounting plates having an upper region upwardly extending from the associated mounting arm;

said upper region of each mounting plate having a generally circular mounting hole therethrough;

said mounting holes of said mounting plates each being adapted for extending a fastener therethrough and into the respective corresponding surface of the skylight opening to secure said mounting plates to the surfaces of the skylight opening;

a generally cylindrical mounting box being downwardly depended from said center region of said mounting bracket;

each of said mounting arms having a downwardly facing generally circular wiring hole adjacent said center region of said mounting bracket;

said mounting box having a plurality of upwardly facing generally circular extension holes, each of said extension holes being coaxially aligned with a corresponding adjacent wiring hole;

said mounting box having a generally circular removable bottom plate coupled thereto and covering a bottom opening of said mounting box; and said bottom plate of said mounting box being adapted for coupling a base of a ceiling fan thereto such that the ceiling fan downwardly depends from the mounting box.

7. A ceiling fan mounting assembly, comprising:

a mounting bracket comprising a plurality of elongate mounting arms outwardly radiating from a center region of said mounting bracket;

a mounting box being downwardly depended from said center region of said mounting bracket;

each of said mounting arms having an outer end opposite said center region of said mounting bracket;

said outer ends of said mounting arms each having a mounting plate coupled thereto;

each of said mounting plates having a mounting barb outwardly extending therefrom; and wherein said each of said mounting arms has a downwardly facing wiring hole adjacent said center region of said mounting bracket, wherein said mounting box has a plurality of upwardly facing extension holes, each of said extension holes being coaxially aligned with a corresponding adjacent wiring hole.

8. The ceiling fan mounting assembly of claim 7, wherein said each of said mounting plates has a knock out hole therethrough providing an opening into said outer end of an associated mounting arm.

9. The ceiling fan mounting assembly of claim 7, wherein said each of said mounting plates has an upper region upwardly extending from an associated mounting arm, and wherein said upper region of each mounting plate has mounting hole therethrough adapted for extending a fastener therethrough.

10. The ceiling fan mounting assembly of claim 7, wherein said mounting box having a removable bottom plate coupled thereto and covering a bottom opening of said mounting box.

* * * * *